US007639193B2

(12) United States Patent
Ooi et al.

(10) Patent No.: US 7,639,193 B2
(45) Date of Patent: Dec. 29, 2009

(54) ANTENNA ASSEMBLY AND ELECTRONIC DEVICE WITH A RETRACTABLE RADIO FREQUENCY RADIATING ELEMENT

(75) Inventors: Boon Hoong Ooi, Kedah (MY); David McClintock, Boynton Beach, FL (US)

(73) Assignee: Motorola, Inc., Schaumburg, IL (US)

( * ) Notice: Subject to any disclaimer, the term of this patent is extended or adjusted under 35 U.S.C. 154(b) by 17 days.

(21) Appl. No.: 12/050,629

(22) Filed: Mar. 18, 2008

(65) Prior Publication Data

US 2009/0237310 A1 Sep. 24, 2009

(51) Int. Cl.
*H01Q 1/24* (2006.01)
*H01Q 1/10* (2006.01)

(52) U.S. Cl. ..... 343/702; 343/901

(58) Field of Classification Search ..... 343/702, 343/900, 901, 715
See application file for complete search history.

(56) References Cited

U.S. PATENT DOCUMENTS 5,168,233 A 12/1992 Zibolski
6,369,764 B1 * 4/2002 Ishikawa ..... 343/702
6,531,986 B2 * 3/2003 Saito ..... 343/702
6,839,033 B2 * 1/2005 Shimabara et al. ..... 343/702
6,952,186 B2 * 10/2005 Saito et al. ..... 343/702
6,992,642 B2 * 1/2006 Goldman et al. ..... 343/901
7,420,516 B2 * 9/2008 Candal et al. ..... 343/702

FOREIGN PATENT DOCUMENTS

WO WO03084021 A1 1/2003

* cited by examiner

*Primary Examiner*—Hoang V Nguyen
(74) *Attorney, Agent, or Firm*—Terri S. Hughes; Anthony P. Curtis

(57) ABSTRACT

An electronic device having a housing with a shroud locator socket. There is a retractable elongate radio frequency radiating element passing through an aperture of the shroud locator socket, the retractable elongate radio frequency radiating element being electrically connected to an electrical circuit located in the housing and being movable from a fully retracted position when substantially located in the housing to a fully extended position when substantially protruding outside the housing. An end cap is located on a free end of the retractable elongate radio frequency radiating element and there is a shroud having transverse ribs that are transverse to a longitudinal axis (X) of the retractable elongate radio frequency radiating element. The shroud covers a protected length (L) of the retractable elongate radio frequency radiating element proximal to the end cap. The shroud extends and tapers away from the end cap towards the shroud locator socket and the shroud operatively engages the shroud locator socket when the retractable elongate radio frequency radiating element is in the fully retracted position.

16 Claims, 4 Drawing Sheets

ANTENNA ASSEMBLY AND ELECTRONIC DEVICE WITH A RETRACTABLE RADIO FREQUENCY RADIATING ELEMENT

FIELD OF THE DISCLOSURE

The present disclosure relates generally to the field of electronic devices having a retractable radio frequency radiating element and retractable antenna assemblies.

BACKGROUND

Typically, wireless-communication devices, such as cellular telephones or personal digital assistants, have a housing containing electronic circuitry, and some form of an antenna assembly for radiating and receiving radio-frequency (RF) signals that is physically mounted to the housing and electrically coupled to the electronic circuitry. For a personal, handheld, wireless-communication device, a desirable antenna assembly has a physical size commensurate with the housing and typically moveable between a retracted position and an extended position relative to the housing. When the device is to be stored in a pocket, a purse, or a bag, the antenna is usually retracted to reduce the device's overall size.

The abovementioned antenna assemblies are often referred to as retractable, whip or telescopic antennas, and they have an end cap adjacent the tip of the antenna to facilitate easy extension and retraction of the retractable antenna. The end cap also functions as a cover for a helical, spiral or meandering radiator element that comprises part of the antenna. In general, the end cap is symmetrical about a longitudinal axis of an antenna and it is typically cylindrical. If the device is dropped when the antenna is in the retracted position, the force from the impact may be directly applied to the antenna. Such a force can permanently bend the antenna or result in a kink in the antenna at an area adjacent to the end cap. This is because movement of the area adjacent to the end cap is restricted as it is inside an aperture (antenna locator) when the antenna is in the retracted position, and therefore the force is not evenly distributed along the full length of the antenna. Further, dropping of the device can have the undesirable affect of substantially weakening or deforming the antenna at the area adjacent to the end cap.

BRIEF DESCRIPTION OF THE FIGURES

In order that the disclosure may be readily understood and put into practical effect, reference will now be made to exemplary embodiments as illustrated with reference to the accompanying figures, where like reference numerals refer to identical or functionally similar elements throughout the separate views. The figures together with a detailed description below, are incorporated in and form part of the specification, and serve to further illustrate the embodiments and explain various principles and advantages, in accordance with the present disclosure where.

Figure 1:
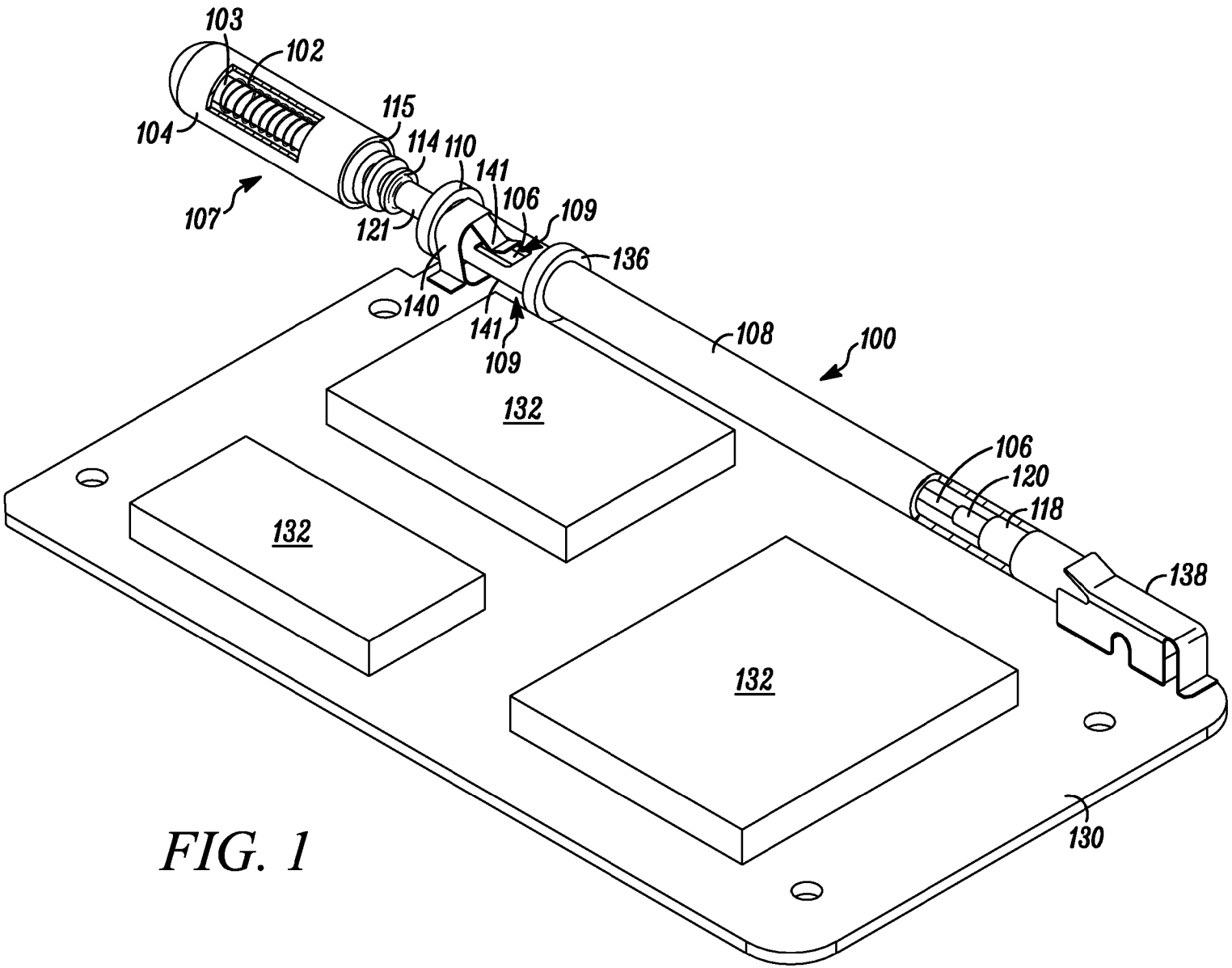
FIG. 1 illustrates a perspective view with partially cut away sections of a retractable antenna assembly in an almost completely retracted position and mounted to a circuit board in accordance with an embodiment of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION

Before describing in detail embodiments that are in accordance with the present disclosure, it should be observed that the embodiments reside primarily in combinations of an electronic device and antenna assembly. Accordingly, the electronic device and the antenna assembly have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that device components that comprises a list of elements does not include only those elements but may include other elements not expressly listed or inherent antenna assemblies. An element proceeded by "comprises . . . a" does not, without more constraints, preclude the existence cover a non-exclusive inclusion, such that a electronic device and antenna assembly that comprises a list of elements does not include only those elements but may include other elements not expressly listed or inherent to such electronic device and of additional identical elements in the electronic device and antenna assembly that comprises the element.

According to one embodiment of the present disclosure there is provided an electronic device comprising a housing with a shroud locator socket. There is a retractable elongate radio frequency radiating element passing through an aperture of the shroud locator socket. The retractable elongate radio frequency radiating element is electrically connected to an electrical circuit located in the housing and is movable from a fully retracted position when substantially located in the housing to a fully extended position when substantially protruding outside the housing. An end cap is located on a free end of the retractable elongate radio frequency radiating element, and there is a shroud having transverse ribs that are transverse to a longitudinal axis of the retractable elongate radio frequency radiating element. The shroud covers a protected length of the retractable elongate radio frequency radiating element proximal to the end cap, wherein the shroud extends and tapers away from the end cap towards the shroud locator socket, and wherein the shroud operatively engages the shroud locator socket when the retractable elongate radio frequency radiating element is in the fully retracted position.

According to another embodiment of the present disclosure, there is provided a retractable antenna assembly comprising a retractable elongate radio frequency radiating that is movable in a ferrule from a fully retracted position to a fully extended position. There is an end cap located on a free end of the retractable elongate radio frequency radiating element and there is a shroud having transverse ribs that are transverse to a longitudinal axis of the retractable elongate radio frequency radiating element. The shroud covers a protected length of the radiating element proximal to the end cap, and wherein the shroud extends and tapers away from the end cap.

Referring to FIG. 1, there is illustrated a retractable antenna assembly 100 in an almost completely retracted position. The retractable antenna assembly 100 has a helical radio frequency radiating element 102 enclosed in an end cap 104 and a linear retractable elongate radio frequency radiating element 106 slidably captive in a ferrule 108 that has a flange 110 at one end.

The helical radio frequency radiating element 102 is typically a compact, spiral-wound length of metal wire wrapped around a former 103 (or an etched meander on a circuit board substrate) and the linear retractable elongate radiating element 106 is typically an elongate straight or tightly-wound length of metal wire that has a free end 107 in electrical contact with an end of the helical radio frequency radiating element 102. Hence, the end cap 104 that encloses the helical radio frequency radiating element 102 is also located at the free end 107 of the linear retractable elongate radiating element 106 and to reduce shorting or signal interference the end cap 104 is an electrical insulator and most of the length of the linear retractable elongate radiating element 106 is covered with an electrical insulator, such as a plastics paint or thin coating. Further, the end cap 104 has a base portion 115 from which there extends a shroud 114 formed from a molded resilient material.

The ferrule 108 can be formed from a thin sheet of conductive material such as, nickel alloy, gold alloy, or copper alloy that at least partially surrounds the linear retractable elongate radiating element 106. The ferrule 108 defines a cylinder that holds captive an insulated end stop 118 that is mounted at one end of the linear retractable elongate radiating element 106. Adjacent the insulated end stop 118 is a connector 120 mounted to a length of the linear retractable elongate radiating element 106 that is not covered with an electrical insulator, such as a plastics paint or thin plastics coating. Near the free end 107 that is the opposite end from the insulated end stop 118 there is another connector 121 mounted to a length of the linear retractable elongate radiating element 106 that is not covered with an electrical insulator.

The flange 110 has an aperture large enough to allow linear retractable radiating element 106 to pass there through whilst disallowing passage of the insulated end stop 118. The retractable antenna assembly 100 is mounted to circuit board 130 of a wireless communication device by mounts 136 and 138. As will be apparent to a person skilled in the art, the circuit board 130 has electronic components 132 mounted thereon forming an electric circuit that is electrically coupled to a spring loaded feed-point contact 140 on the circuit board 130.

The feed-point contact 140 comprises two opposing spring loaded fingers 141 that are in slidable contact with the linear retractable elongate radiating element 106 through respective notches (apertures) 109 in the ferrule. The circuit board 130 further includes a ground plane (not shown) that is electrically coupled to the ferrule 108 by the mount 138, the mount 138 being typically formed from a metal or metal alloy and provides a ground path from retractable antenna assembly 100 to ground plane of the circuit board 130.

The feed contact point 140 provides electrical coupling (electrical connection) between the linear retractable elongate radiating element 106 of the retractable antenna assembly 100 and the electrical circuit on the circuit board 130 such that when the retractable antenna assembly 100 is in a fully retracted position the feed contact point 140, at the two opposing spring loaded fingers 141, electrically contacts the connector 121 of the linear retractable elongate radiating element 106. Also, when the retractable antenna assembly 100 in the fully extended position, the feed contact point 140, at the two opposing spring loaded fingers 141, electrically contacts the connector 120 touches the linear retractable elongate radiating element 106.

Figure 2:
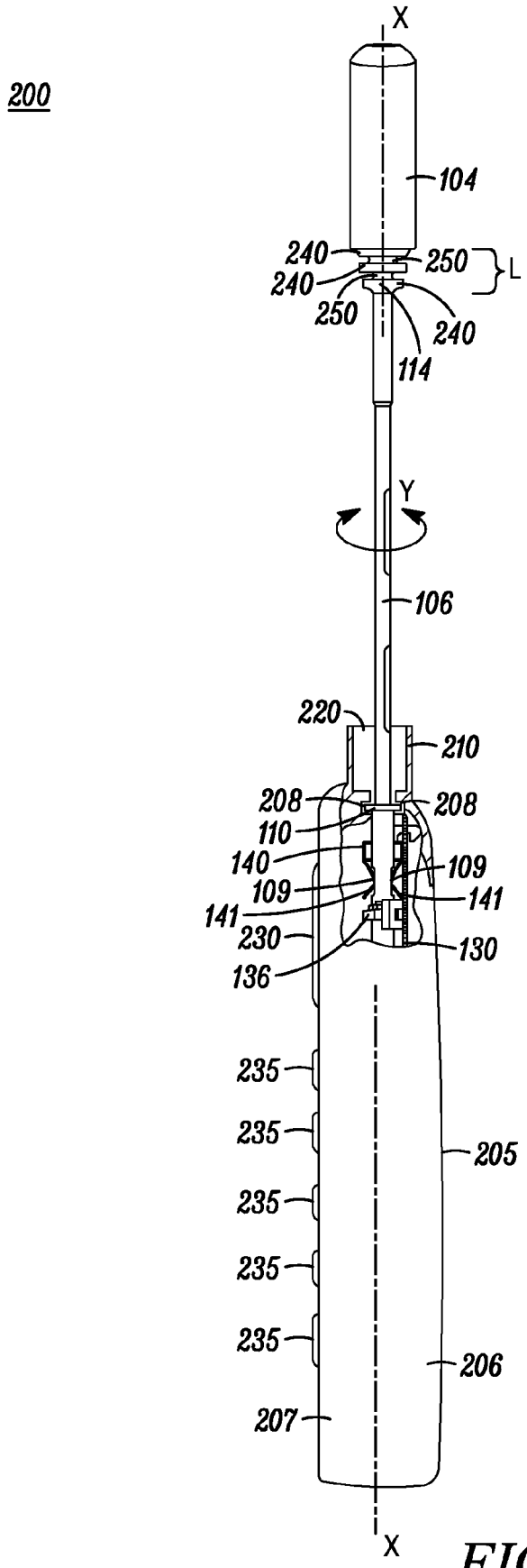
FIG. 2 illustrates a right-side elevation view with a partially cut away section of an electronic device with the retractable antenna assembly of FIG. 1 in a fully extended position in accordance with an embodiment of the disclosure.

Referring to FIG. 2, there is illustrated an electronic device 200 comprising the retractable antenna assembly 100 when in a fully extended position. In this embodiment, the circuit board 130 is mounted in a housing 205 of the electronic device 200, and thus, the electronic components 132 mounted thereon forming an electric circuit are located in the housing 205. The housing 205 comprises two sections 206, 207 with a shroud locator socket 210 adjacent to the flange 110. The flange 110 is held captive by two respective aligned half annular grooves 208 in the two sections 206, 207 that sandwich and retain the flange 110. Visible and accessible outside the housing are a display screen 230 and keys 235. The shroud locator socket 210 has an aperture 220 to allow the linear retractable elongate radiating element 106 to pass there through and retract and extend along a longitudinal axis X as well as allowing linear retractable elongate radiating element 106 to rotate about a longitudinal axis X as illustrated by arrowed line Y.

As illustrated, the shroud 114 has transverse ribs 240 that are transverse to the longitudinal axis X of the linear retractable elongate radio frequency radiating element 106. The shroud 114 covers a protected length L of the radiating element that is proximal to the end cap 104 and the shroud extends and tapers away from the end cap 104 towards the shroud locator socket 210. Further, the transverse ribs 240 are spaced by respective grooves 250 in the shroud 114 and typically both the transverse ribs 240 and grooves 250 have a circumferential outline.

Figure 3:
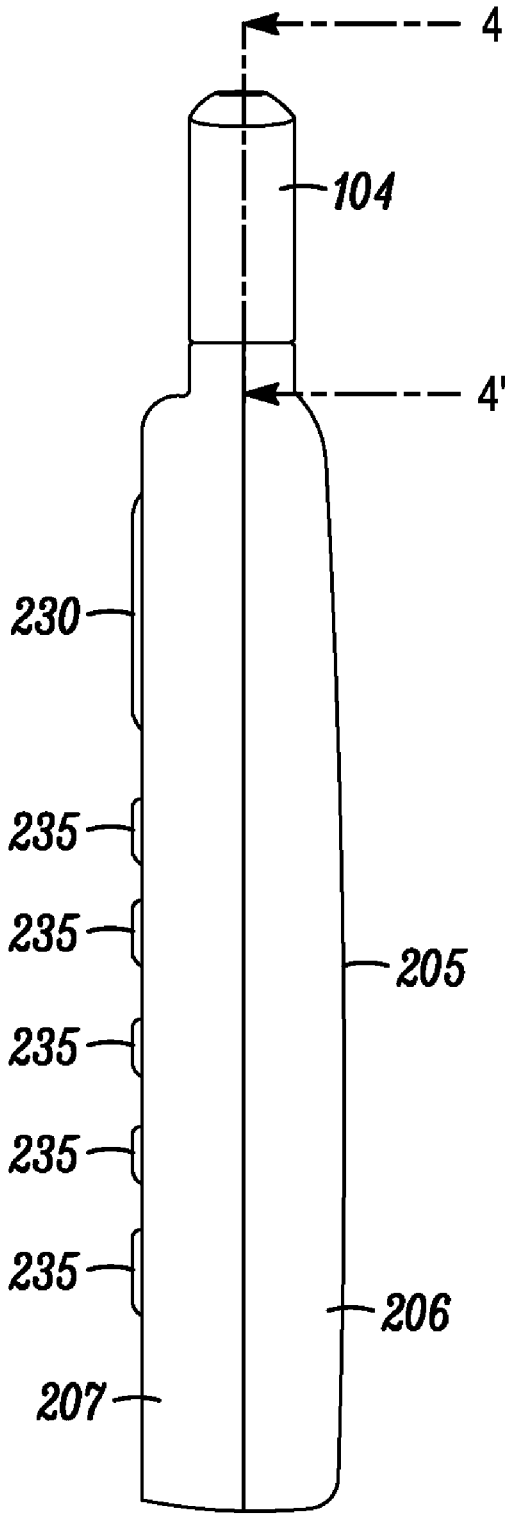
FIG. 3 illustrates a right-side elevation view of FIG. 2, without the partially cut away section, when the retractable antenna assembly is in a fully retracted position in accordance with an embodiment of the disclosure.
Figure 4:
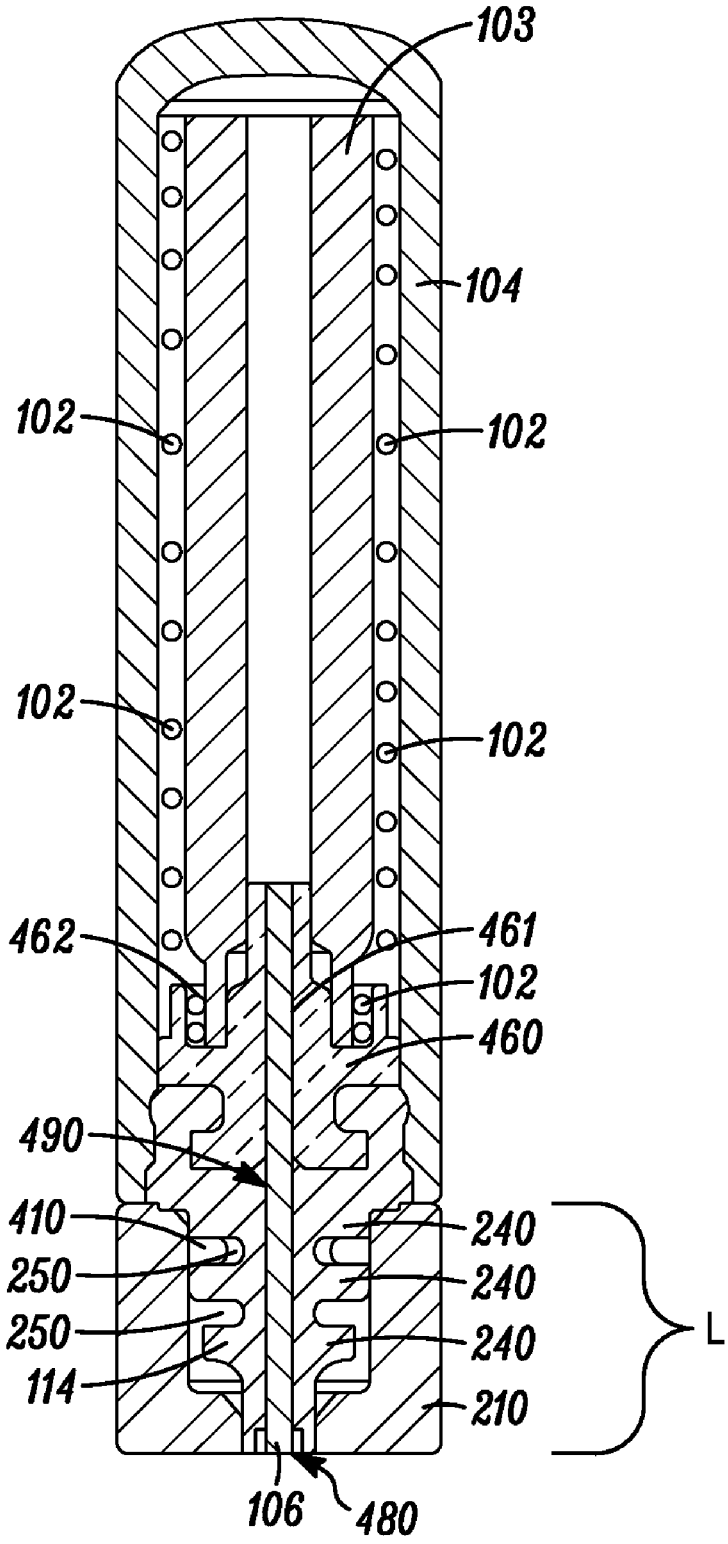
FIG. 4 illustrates a cross sectional view through 4-4' of FIG. 3 in accordance with an embodiment of the disclosure.

The linear retractable elongate radiating element 106 is moveable relative to housing 205 from the fully extended position of FIG. 2 to a fully retracted position as shown in FIG. 3. Referring to FIG. 3, there is illustrated the electronic device 200 comprising the retractable antenna assembly 100 when in the fully retracted position. When in the retractable antenna assembly 100 is in the fully retracted position, the shroud 114 operatively engages the shroud locator socket 210. As specifically shown in FIG. 4, the shroud 114 operatively engages the shroud locator socket 210 when the linear retractable elongate radio frequency radiating element 106 is in the fully retracted position. As illustrated, respective circumferences of the transverse ribs 240 decrease along the protected length L that protects potential weak points 480 and 490 of the linear retractable elongate radio frequency radiating element 106, wherein one of the ribs 240 furthest away from the end cap 104 has a smaller circumference than one of the ribs 240 closest to the end cap 104. Also, the grooves are typically of identical circumferences and the shroud locator socket 210, has a protrusion 410 extending from a wall of the aperture 220 of the shroud locator socket 210. The wall of the aperture 220 is suitably cylindrical in shape and the protrusion 410, in one form, is typically annular. When the retractable elongate radio frequency radiating element 106 is in the fully retracted position, the protrusion 410 engages one of the grooves 250 to thereby retain the retractable elongate radio frequency radiating element 106 in the retracted position.

In the cross section along the longitudinal axis X, the ribs 240 form zeniths, and the grooves 250 form nadirs. For added structural reinforcement, the shroud 114 is directly mounted to the end cap 104 and the linear retractable elongate radiating element 106 electrically is connected to the helical radio frequency radiating element 102 at yoke 460 that is enclosed in the end cap. The yoke 460 has an aperture 461 that engages, with an interference fit, the free end of the retractable elongate radio frequency radiating element 106 and the helical radio frequency radiating element 102 engages the yoke 460 at annular slot 462 co-acting with the former 103 to thereby sandwich and retain electrical engagement of the helical radio frequency radiating element 102 with the yoke 460. The shroud 114 has a stiffness of around 45 Shaw D and is molded polyurethane, the stiffness of the shroud 114 is less than the stiffness of the retractable elongate radio frequency radiating element 106 is typically formed from a Nickel-Titanium rod.

Advantageously, the present disclosure provides for alleviating damage, such as permanently bending or kinking of the retractable elongate radio frequency radiating element 106 at the protected length L due to dropping of the device 100. More specifically, if the device 100 is dropped, when the retractable elongate radio frequency radiating element 106 (antenna) is in the fully retracted position, the shroud 114 by virtue of the transverse ribs 240 and grooves 250 (one of which is engaging the protrusion 410 absorbs forces resulting from the impact that are transverse to the longitudinal axis X. Hence, the possibility of kinks or bends that may otherwise occur due to dropping of the device 100 at the potential weak points 480 and 490 are reduced.

In the foregoing specification, specific embodiments of the present disclosure have been described. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims.

We claim:

1. An electronic device comprising:

a housing with a shroud locator socket;

a retractable elongate radio frequency radiating element passing through an aperture of the shroud locator socket, the retractable elongate radio frequency radiating element being electrically connected to an electrical circuit located in the housing and being movable from a fully retracted position when substantially located in the housing to a fully extended position when substantially protruding outside the housing;

an end cap located on a free end of the retractable elongate radio frequency radiating element; and a shroud having transverse ribs that are transverse to a longitudinal axis of the retractable elongate radio frequency radiating element, the shroud covering a protected length of the retractable elongate radio frequency radiating element proximal to the end cap, wherein the shroud extends and tapers away from the end cap towards the shroud locator socket, and wherein the shroud operatively engages the shroud locator socket when the retractable elongate radio frequency radiating element is in the fully retracted position.

2. The electronic device of claim 1, wherein the transverse ribs are spaced by respective grooves in the shroud.

3. The electronic device of claim 2, wherein the grooves have a circumferential outline.

4. The electronic device of claim 2, wherein the transverse ribs have a circumferential outline.

5. The electronic device of claim 4, wherein respective circumferences of the transverse ribs decrease along the protected length, wherein one of the transverse ribs furthest away from the end cap has a smaller circumference than one of the transverse ribs closest to the end cap.

6. The electronic device of claim 4, wherein the shroud locator socket has a protrusion extending from a wall of an aperture of the shroud locator socket, wherein when the retractable elongate radio frequency radiating element is in the fully retracted position the protrusion engages one of the grooves to thereby retain the retractable elongate radio frequency radiating element is in the retracted position.

7. The electronic device of claim 2, wherein the grooves are of identical circumferences.

8. The electronic device of claim 1, wherein the shroud is formed from a molded resilient material.

9. The electronic device of claim 1, wherein in cross section along the longitudinal axis the transverse ribs form zeniths.

10. The electronic device of claim 9, wherein in cross section along the longitudinal axis the grooves form nadirs.

11. The electronic device of claim 1, wherein the shroud is directly mounted to the end cap.

12. The electronic device of claim 1, wherein the end cap encloses a helical radio frequency radiating element.

13. A retractable antenna assembly comprising;

a retractable elongate radio frequency radiating element movable in a ferrule from a fully retracted position to a fully extended position;

an end cap located on a free end of the retractable elongate radio frequency radiating element; and a shroud having transverse ribs that are transverse to a longitudinal axis of the retractable elongate radio frequency radiating element, the shroud covering a protected length of the radiating element proximal to the end cap, and wherein the shroud extends and tapers away from the end cap.

14. The retractable antenna assembly of claim 13, wherein the transverse ribs are spaced by respective grooves in the shroud.

15. The retractable antenna assembly of claim 14, wherein the grooves have a circumferential outline.

16. The retractable antenna assembly of claim 14, wherein the transverse ribs have a circumferential outline.

* * * * *

UNITED STATES PATENT AND TRADEMARK OFFICE

CERTIFICATE OF CORRECTION

PATENT NO. : 7,639,193 B2
APPLICATION NO. : 12/050629
DATED : December 29, 2009
INVENTOR(S) : Ooi et al.

It is certified that error appears in the above-identified patent and that said Letters Patent is hereby corrected as shown below:

ON THE COVER PAGE

On the Cover Page, item (56), under "FOREIGN PATENT DOCUMENTS", in Column 2, Line 1, delete "1/2003" and insert -- 10/2003 --, therefor.

In Column 6, Line 39, in Claim 13, delete "comprising;" and insert -- comprising: --, therefor.

Signed and Sealed this
Fourth Day of October, 2011

David J. Kappos

David J. Kappos
*Director of the United States Patent and Trademark Office*